US008286891B2

(12) United States Patent
Cox et al.

(10) Patent No.: US 8,286,891 B2
(45) Date of Patent: Oct. 16, 2012

(54) COMPONENTS FOR RAIL FASTENING ASSEMBLY

(75) Inventors: Stephen John Cox, Richmond (GB); Robert John Hamilton, Woking (GB)

(73) Assignee: Pandrol Limited, Addlestone, Surrey (GB)

( * ) Notice: Subject to any disclaimer, the term of this patent is extended or adjusted under 35 U.S.C. 154(b) by 280 days.

(21) Appl. No.: 12/665,683

(22) PCT Filed: Jul. 4, 2007

(86) PCT No.: PCT/GB2007/002488

§ 371 (c)(1), (2), (4) Date: Feb. 11, 2010

(87) PCT Pub. No.: WO2009/004274

PCT Pub. Date: Jan. 8, 2009

(65) Prior Publication Data

US 2010/0181386 A1 Jul. 22, 2010

(51) Int. Cl.
*E01B 9/02* (2006.01)
*E01B 9/30* (2006.01)

(52) U.S. Cl. ..... 238/349; 238/351

(58) Field of Classification Search ..... 238/349, 238/351, 315, 338, 340, 341, 343, 344, 345, 238/348, 352, 353, 354
See application file for complete search history.

(56) References Cited

U.S. PATENT DOCUMENTS

| | | | | |
|---|---|---|---|---|
| 2,257,923 | A * | 10/1941 | Verplanck | 238/283 |
| 5,865,370 | A | 2/1999 | Sonneville et al. | |
| 6,726,117 | B2 * | 4/2004 | Herb et al. | 238/315 |

FOREIGN PATENT DOCUMENTS

| | | | |
|---|---|---|---|
| FR | 2618463 | * | 1/1989 |
| GB | 2 074 638 | | 11/1981 |
| GB | 2 105 389 | | 3/1983 |
| GB | 2 152 120 | | 7/1985 |
| GB | 2 435 285 | | 8/2007 |
| WO | WO 93/12296 | | 6/1993 |
| WO | WO 01/38642 | | 5/2001 |
| WO | WO 01/73203 | | 10/2001 |

OTHER PUBLICATIONS

International Search Report and Written Opinion of the International Searching Authority, mailed May 5, 2008 corresponding to International application No. PCT/GB2007/002488.

UK Search Report, dated Nov. 1, 2007 corresponding to United Kingdom application No. GB0712977.8.

UK Search Report, dated Dec. 24, 2007 corresponding to United Kingdom application No. GB0712977.8.

* cited by examiner

*Primary Examiner* — Mark Le
(74) *Attorney, Agent, or Firm* — Husch Blackwell LLP

(57) ABSTRACT

A component for use in a rail fastening assembly, the assembly comprising a railway rail fastening clip having a first part for bearing on a railway rail and a railway rail clip anchoring device for retaining the railway rail clip, comprises a first portion adapted to receive a lateral load from the rail when located between a substantially upright face of the rail clip anchoring device and the side of the foot of an adjacent railway rail when the assembly is in use. The component further comprises a second portion for receiving a second bearing part of the railway rail clip. The first portion and the second portion of the component are spaced apart and interconnected by a connection portion.

25 Claims, 13 Drawing Sheets

COMPONENTS FOR RAIL FASTENING ASSEMBLY

Figure 1A:
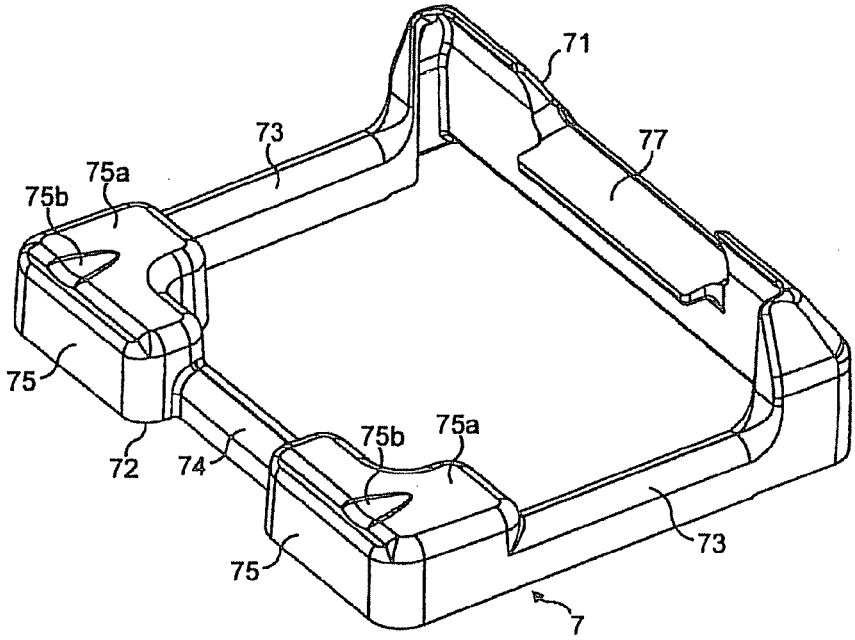

The present invention relates to components for a rail fastening assembly.

In the documents WO93/12294, WO93/12295 and WO93/12296, the present applicants disclosed a railway rail fastening system in which a rail fastening clip is driven laterally onto the rail and can be held in a clip anchoring device (shoulder) in a "pre-assembly" or "parked" position in which the toe portion of the clip does not bear on the rail. This enables railway sleepers to be preloaded at the factory with clips which are held in the pre-assembly position such that when the sleepers are delivered to site the clips can simply be driven home once the rail is in place. In addition, when maintenance of the rail is subsequently required, the clip can be driven off the rail back into the pre-assembly position. Such clips are sometimes known as "switch-on/switch-off" clips. Such a fastening system has proved to be very successful, but the applicant is desirous of making improvements to some aspects of its manufacture and use.

In a previous application, unpublished at the date of filing the present application, the applicants disclose a shoulder in which clip-engaging features on the lower part of the walls of the shoulder are absent. Accordingly, it is necessary to provide an alternative clip bearing part for the heels of the clip.

According to a first aspect of the present invention there is provided a component for use in a rail fastening assembly, the assembly comprising a railway rail fastening clip having a first part for bearing on a railway rail and a railway rail clip anchoring device for retaining the railway rail clip, which component comprises a first portion adapted to receive a lateral load from the rail when located between a substantially upright face of the rail clip anchoring device and the side of the foot of an adjacent railway rail when the assembly is in use; wherein the component further comprises a second portion for receiving a second bearing part of the railway rail clip; and the first portion and the second portion of the component are spaced apart and interconnected by a connection portion. Thus, the component can provide the missing heel bearing parts of the anchoring device. In addition, if the heel bearing parts of the component require replacement because of wear or damage, this can be done quickly and easily. It is also easy to replace the component by one having a first portion of greater or lesser thickness and/or a second portion of greater or smaller height, if adjustment of the characteristics of the assembly is required. Moreover, by interconnecting the first and second portions, the number of loose parts that need to be provided and assembled at the sleeper factory and to make repairs in the field can be minimised.

The first portion is preferably adapted to transmit the lateral load received from the rail to the rail clip anchoring device. Thus, the first portion functions as a sidepost.

The connection portion desirably comprises at least one elongate member extending between the first and second portions. As the elongate member need not receive lateral load from the rail, relatively small and thin members can be used, reducing the cost of the materials required.

The connection portion preferably joins the first and second portions of the component such that, when the first portion is located between the anchoring device and the rail foot, the connection portion extends outside the periphery of the anchoring device.

In a preferred embodiment, the connection portion comprises two elongate members, one elongate member extending between respective first points on the first and second portions and the other elongate member extending between respective second points on the first and second portions. If a region bounded by the interconnected elongate members, first portion and second portion is shaped so as to accommodate the rail clip anchoring device, the component may be installed in the rail fastening assembly simply by slipping the component over the top of the anchoring device. Desirably, the component fits closely around a base portion of the anchoring device.

The component may advantageously be integrally formed, preferably of material having a hardwearing surface which can cope with the demands placed on both the first and second portions. Alternatively, one part could be co-injected and two different materials used if required. If the first portion of the component is to form an insulator, at least the first portion is formed of electrically-insulating material. In any case, the component is preferably formed of plastics material, for example nylon.

The second portion preferably comprises at least one structure which extends upwardly, when the component is in use, to define a clip-receiving surface. The second portion desirably comprises two spaced-apart clip seat regions, each having a clip-receiving surface. The clip seat regions may be formed by respective interconnected structures. If the component is approximately rectangular in outline, the clip seat regions may be located respectively at adjacent corners of the component. Desirably, each clip seat region is substantially L-shaped in cross-section when viewed substantially perpendicularly to the clip receiving surfaces.

The first portion may have at least one part which overlies part of the anchoring device. In this case, the part may be such that it is overlain by the rail fastening clip when the clip is retained by the anchoring device.

When a component embodying the present invention is in combination with a railway rail clip anchoring device, the first portion of the component is located adjacent to a substantially upright face of the anchoring device which is to face the foot of a railway rail when the device is in use and the second portion is located on the opposite side of the anchoring device to the said substantially upright face. The second portion serves as a heel seat portion of the anchoring device upon which the heel portion of the rail fastening clip bears when the device is in use.

According to a second aspect of the present invention, there is provided a sealing plate, for use with a rail clip anchoring device having a head and a stem which extends from the head into a concrete sleeper when the anchoring device is in use, the plate being designed to extend over the underside of the head when the stem of the device is being set in a concrete sleeper, thereby to prevent ingress of concrete into the head of the device, and to be retained on the surface of the sleeper thereafter.

The plate is desirably made, for example, of plastics material, for example polypropylene.

The sealing plate may be used to seal the aperture in the mould pocket during sleeper manufacture and prevent the ingress of concrete into the head of the shoulder. When in use the sealing plate is effectively glued on to the top of the concrete sleeper, such that its top face is flush with the face of the top surface of the concrete on the sleeper top.

According to a third aspect of the present invention, there is provided a rail fastening assembly comprising a sealing plate embodying the second aspect of the present invention, a rail clip anchoring device, and a component embodying the first aspect of the present invention. The sealing plate hooks onto the shoulder and thereafter provides a flat bearing surface for the heel seat/side-post component.

Figure 1B:
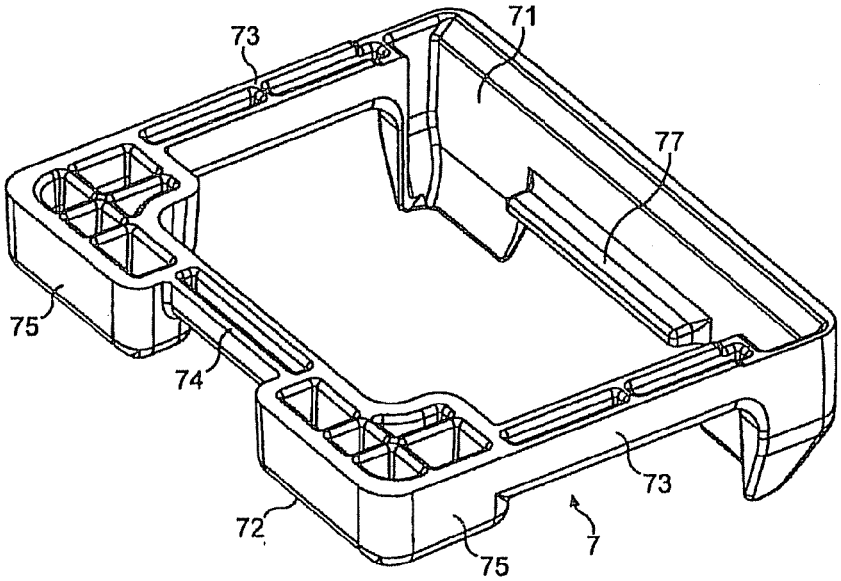
Figure 1C:
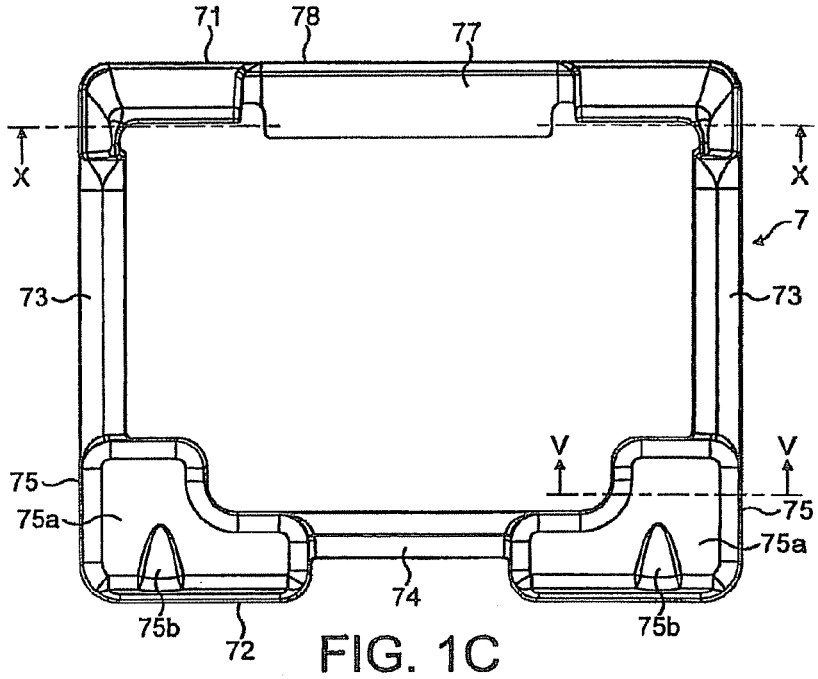
Figure 1D:
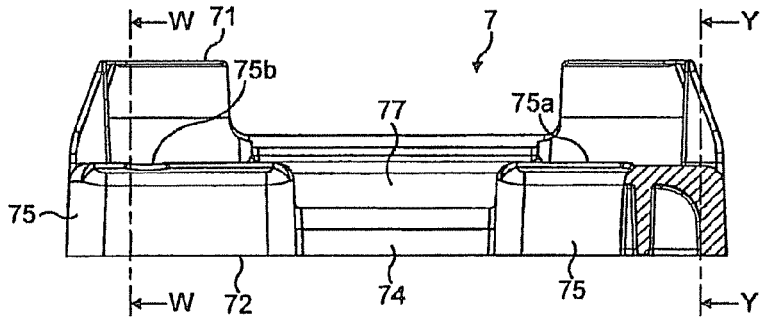
Figure 1E:
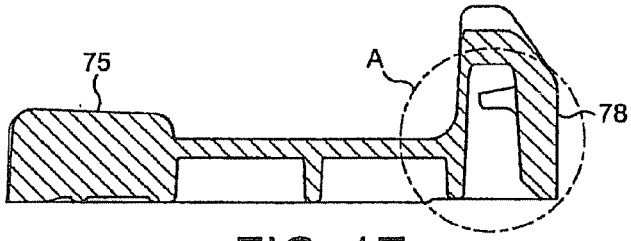
Figure 1F:
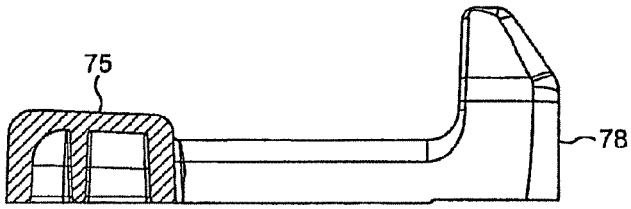
Figure 1G:
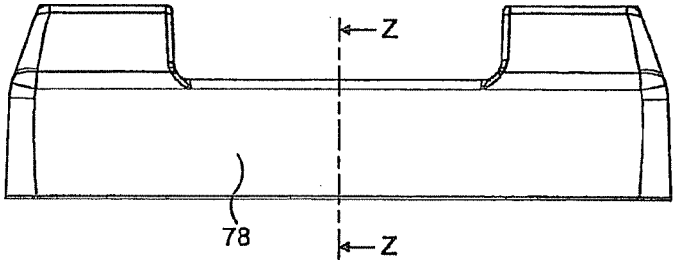
Figure 1H:
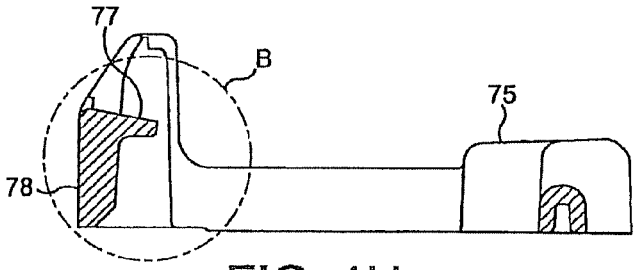
Figure 1J:
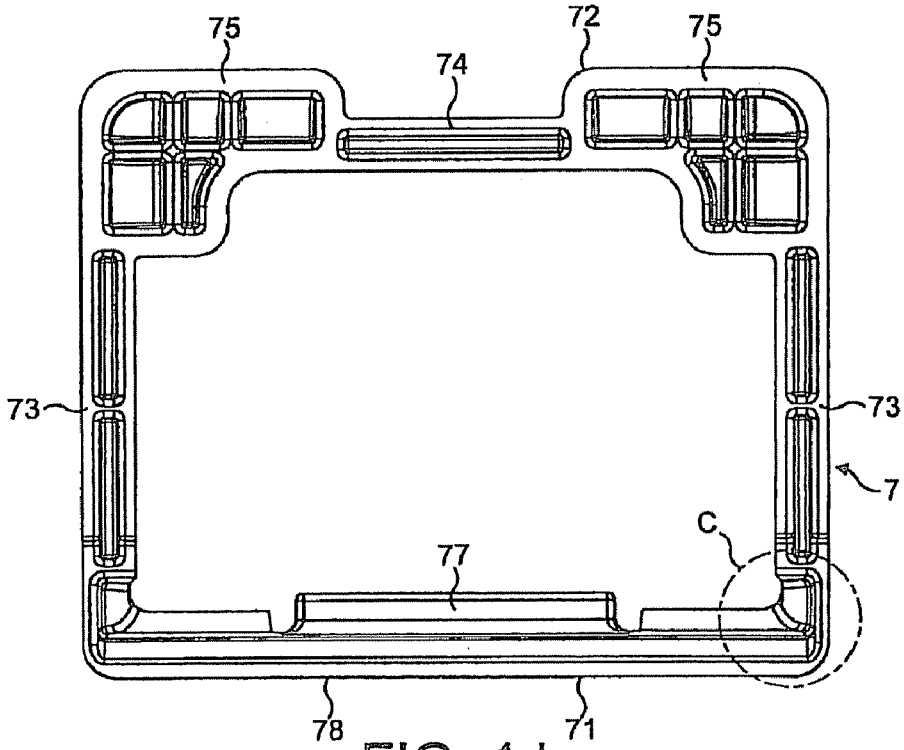
Figure 1K:
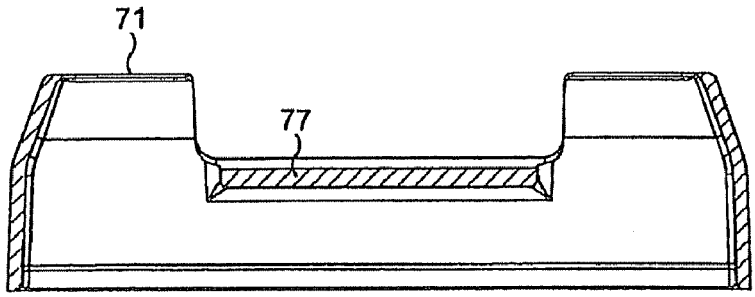
Figure 1L:
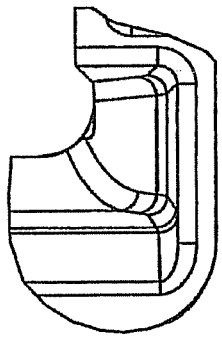
Figure 1M:
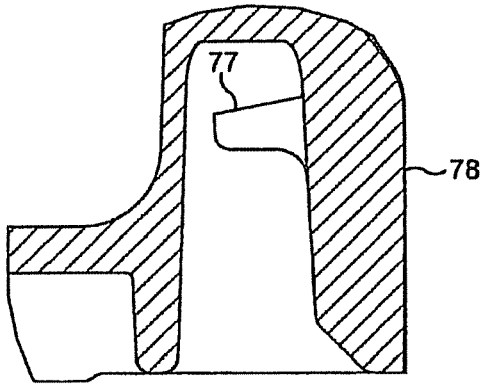
Figure 1I:
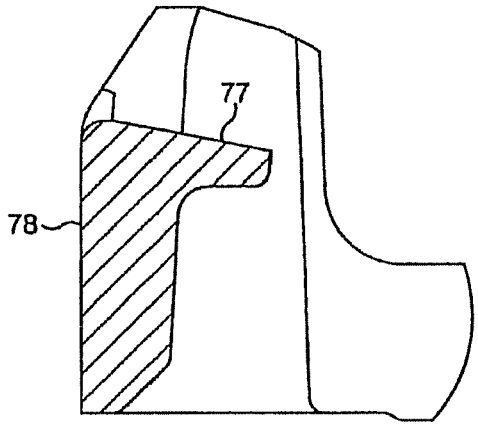
Figure 2A:
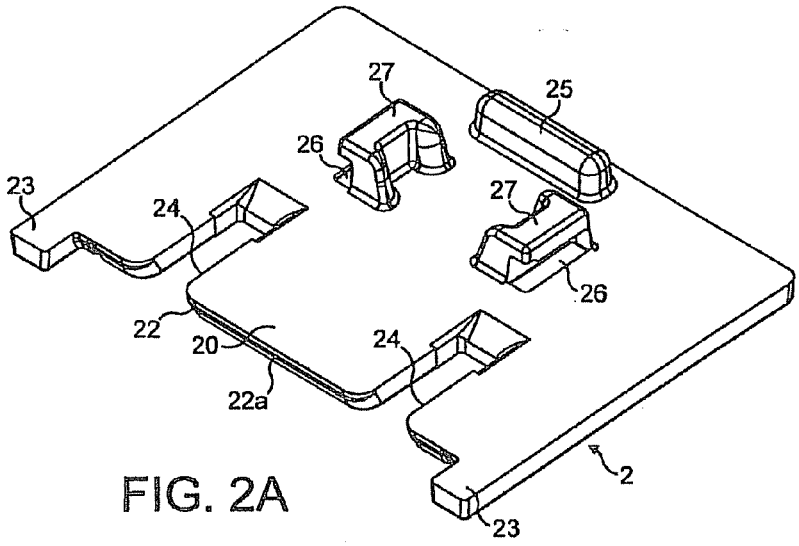
Figure 2B:
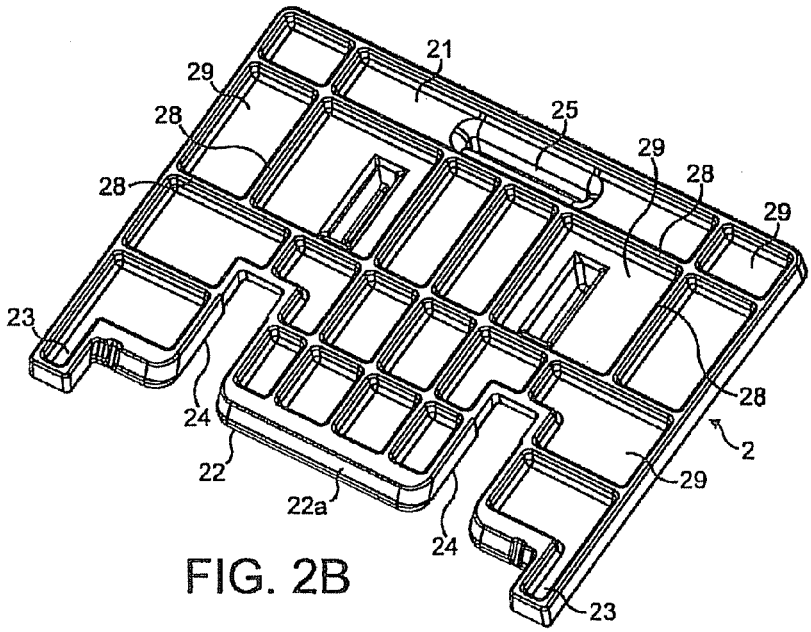
Figure 2C:
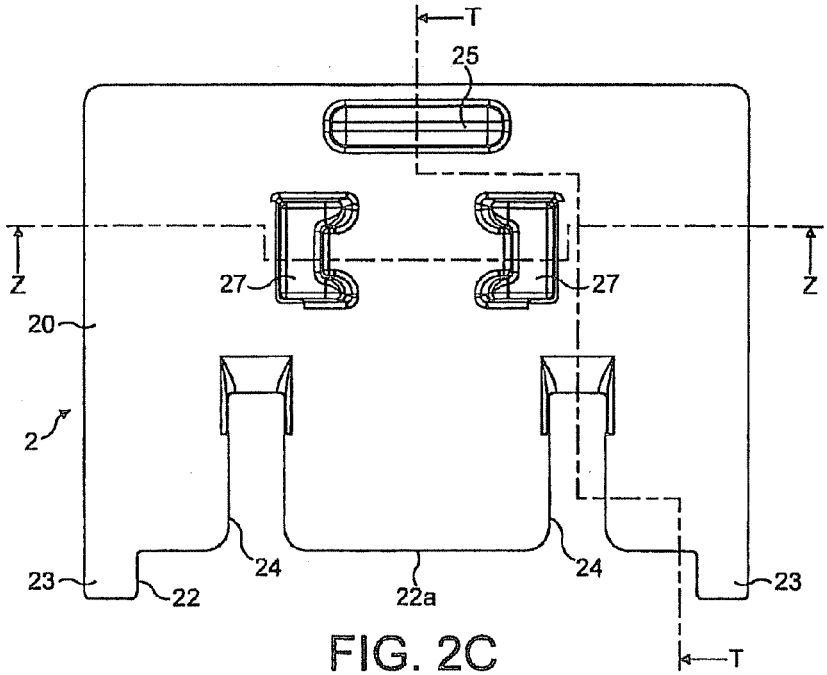
Figure 2D:
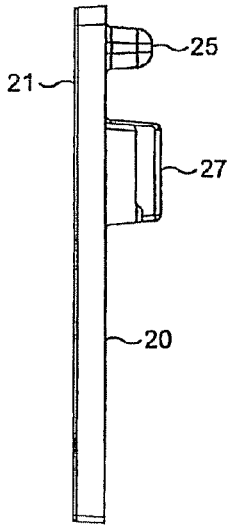
Figure 2E:
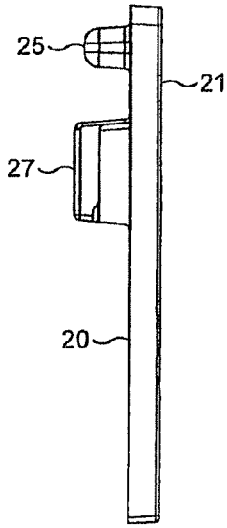
Figure 2F:
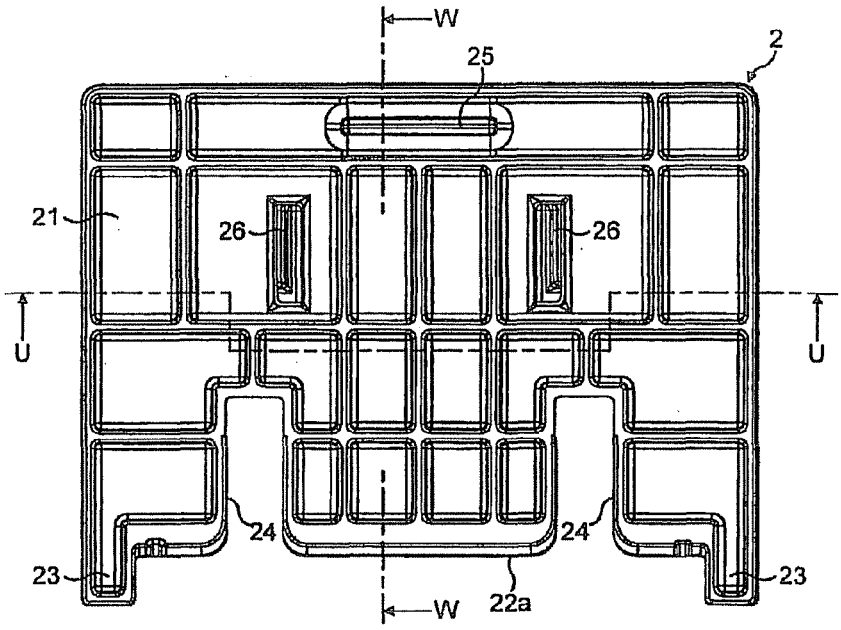
Figure 2G:
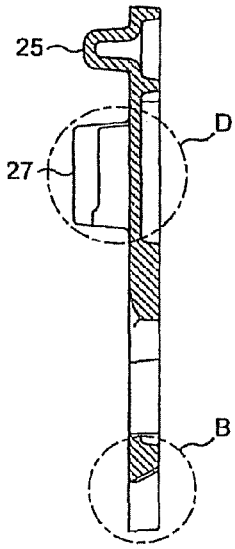
Figure 2H:
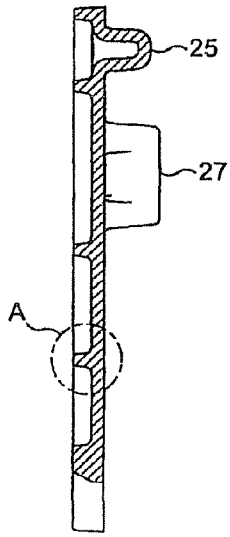
Figure 2J:
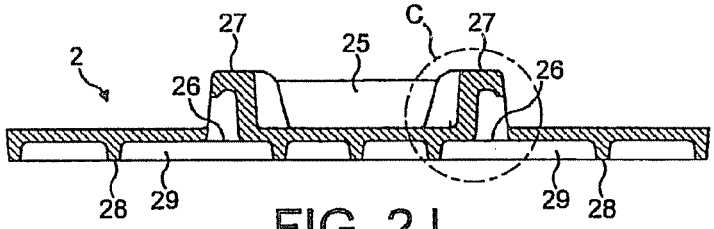
Figure 2K:
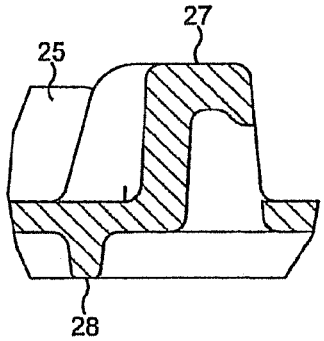
Figure 2L:
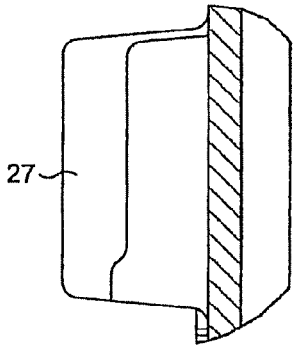
Figure 2M:
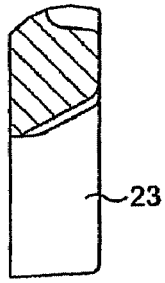
Figure 2N:
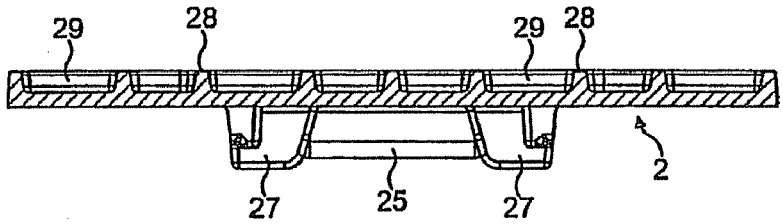
Figure 2I:
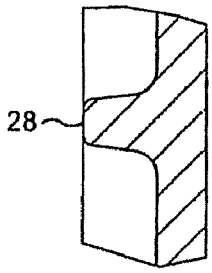
Figure 3A:
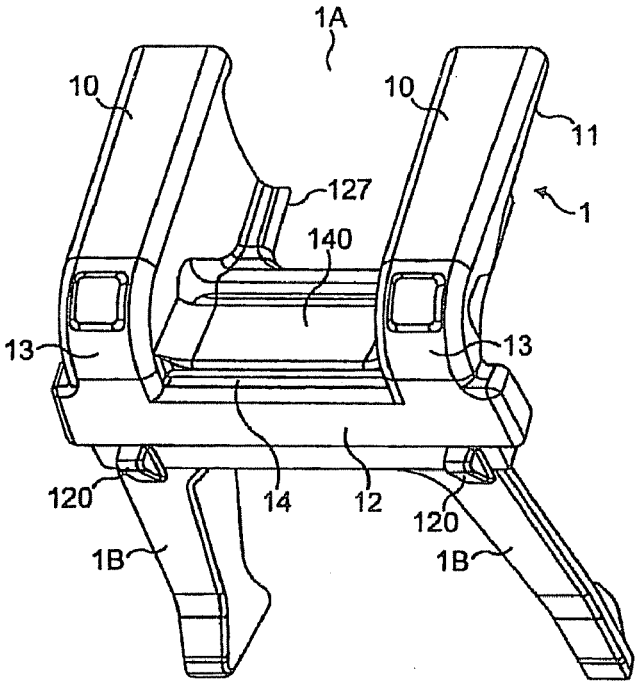
Figure 3B:
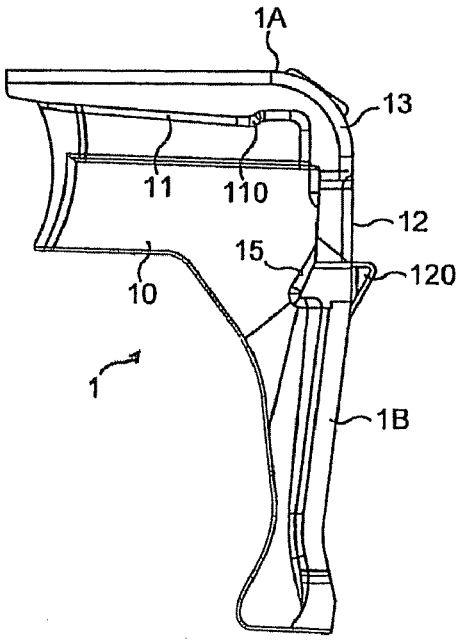
Figure 4A:
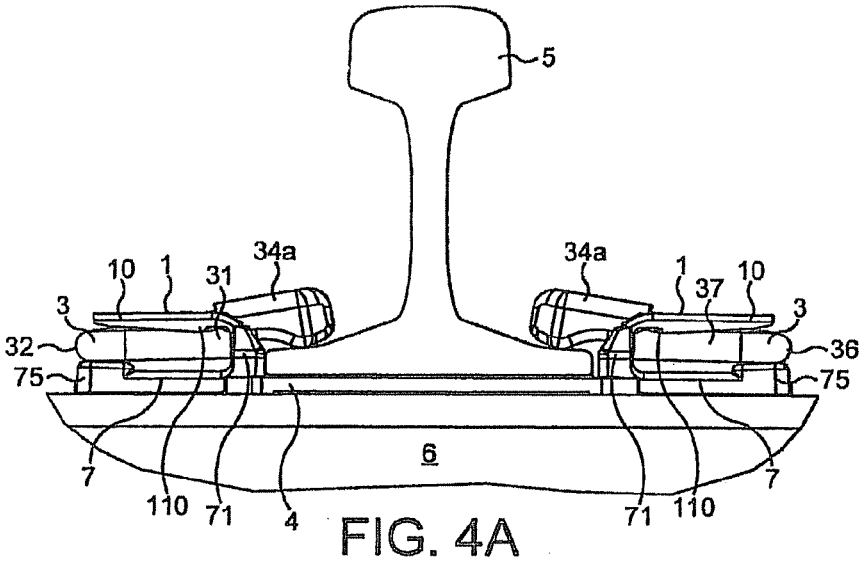
Figure 4B:
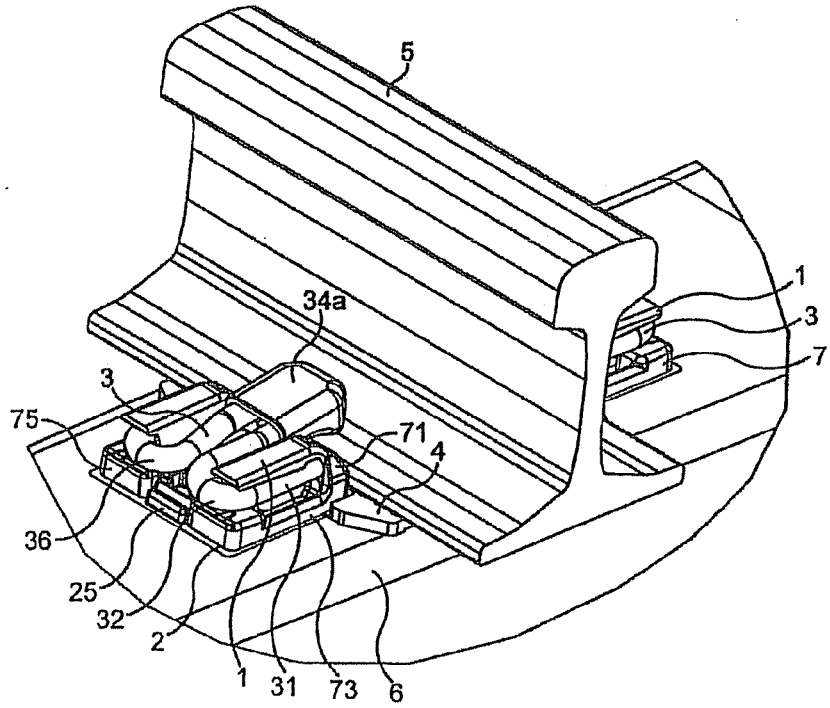
Figure 4C:
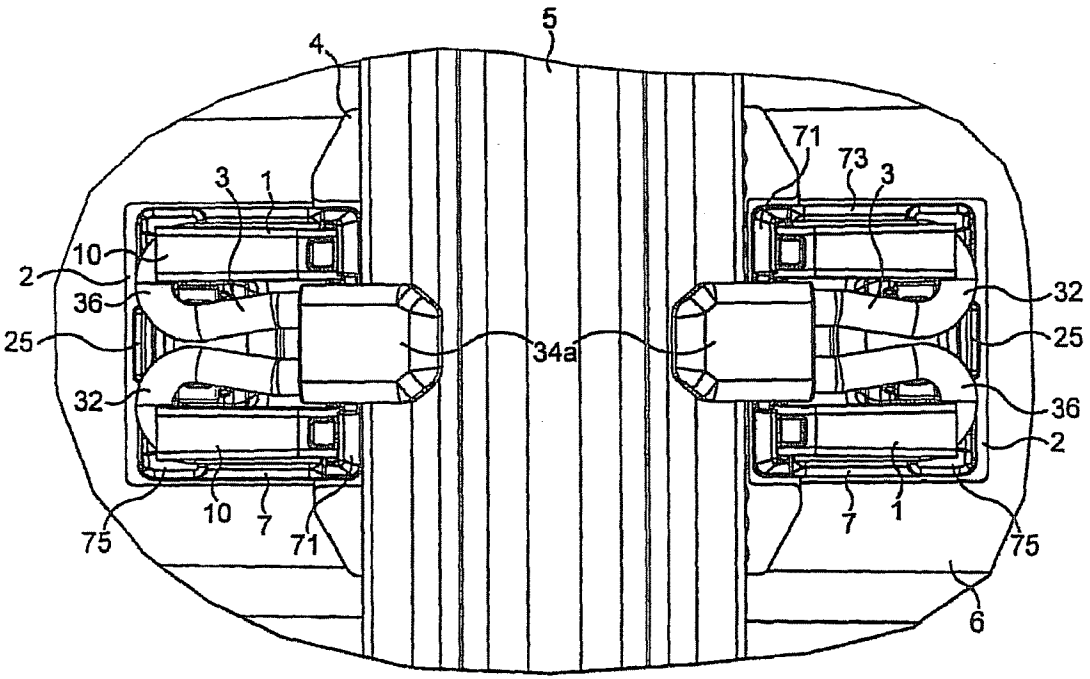

Reference will now be made, by way of example, to the accompanying drawings in which:

FIG. 1A-1M shows a component plate embodying the first aspect of the present invention, FIG. 1A showing a perspective view from above, FIG. 1B showing a perspective view from below, FIG. 1C showing a plan view from above, FIG. 1D showing a part sectional view taken on line V-V in FIG. 1C, FIG. 1E showing a sectional view taken on line Y-Y in FIG. 1D, FIG. 1F showing a part sectional view taken on line W-W in FIG. 1E, FIG. 1G showing a front view of the component, FIG. 1H showing a sectional view taken on line Z-Z in FIG. 1G, FIG. 1J showing a plan view from below, FIG. 1K showing a sectional view taken on line X-X in FIG. 1C, FIG. 1L showing a detail C from FIG. 1J, FIG. 1M showing a detail A from FIG. 1E, and FIG. 1I showing a detail B from FIG. 1H;

FIG. 2 shows a sealing plate embodying the second aspect of the present invention, FIG. 2A showing a perspective view from above, FIG. 2B showing a perspective view from below, FIG. 2C showing a plan view of the top surface of the sealing plate, FIGS. 2D and 2E showing respective side views, FIG. 2F showing a plan view of the underside of the sealing plate, FIG. 2G showing a sectional view taken along the line T-T in FIG. 2C, FIG. 2H showing a sectional view taken along the line W-W in FIG. 2F, FIG. 2J showing a sectional view taken along the line Z-Z in FIG. 2C, FIG. 2K showing a detail C from FIG. 2J, FIG. 2L showing a detail D from FIG. 2G, FIG. 2M showing a detail B from FIG. 2G, FIG. 2N showing a sectional view taken along the line U-U in FIG. 2F, and FIG. 2I showing a detail A from FIG. 2H;

FIG. 3 shows an anchoring device suitable for use with a component embodying the first aspect of the present invention and a sealing plate embodying the second aspect of the present invention, FIG. 3A showing a perspective view from above and FIG. 3B showing a side view; and FIG. 4 shows a railway rail fastening assembly employing a component embodying the first aspect of the present invention and a sealing plate embodying the second aspect of the present invention, in which FIG. 4A shows the assembly in a side view in which a rail fastening clip is bearing on the rail, FIG. 4B shows a perspective view of the assembly, and FIG. 4C is a plan view from above.

As shown in FIGS. 1A to 1M, a component 7 embodying the first aspect of the present invention comprises a first portion 71 and a second portion 72. Respective ends of the first and second portions are connected together by means of two elongate members 73.

The first portion 71 is shaped so as to function as a sidepost insulator, having a substantially upright bearing face 78 which receives lateral loads from the rail and transmits them to an adjacent rail clip anchoring device 1 (see FIG. 3) and a shelf 77 which overlies part of the anchoring device 1.

The second portion 72 comprises two spaced-apart clip seat regions 75, joined together by an elongate member 74. The clip seat regions 75 have respective L-shaped clip receiving surfaces 75*a*. The rear edge of each surface 75*a* is provided with a recess 75*b* shaped to ease installation of the clip.

The elongate members 73, 74 and clip seat regions 75 are substantially hollow structures, having strengthening ribs as required.

A plastic sealing plate 2 embodying the second aspect of the present invention will now be described with reference to FIGS. 2A to 2N. The sealing plate 2 has a first major face 20 which is uppermost when the plate 2 is in use on the top of a sleeper and a second major face 21 opposite to the first. The sealing plate 2 is substantially rectangular in outline, having a cut-out portion along one side 22, defining ears 23 which ensure a seal at the corners of a shoulder 1 located above the plate 2 within the cut-out 22. The cut-out 22 has a bevelled edge 22*a* which mates with a corresponding bevelled edge on a rear face 15 of the shoulder 1. The cut-out 22 also has recesses 24 for receiving twin stems of the shoulder 1 (see FIG. 3).

An example of an anchoring device (shoulder), suitable for use with a component embodying the first aspect of the present invention and a sealing plate embodying the second aspect of the invention, will now be described with reference to FIGS. 3A and 3B. The anchoring device 1 shown in FIG. 3 comprises a head 1A from the underside of which downwardly project two stems 1B for embedding in the concrete sleeper during its manufacture. Alternatively, a Y-shaped stem may be used.

The head 1A of the anchoring device 1 comprises two spaced-part walls 10, connected together at one end of the head 1A, at the bottom of the walls 10, by a connection portion 14. The top surface of the connection portion 14 is downwardly inclined and forms a ramp 140, while the front surface of the connection portion 14 forms the front face 12 of the shoulder 1. The end of the walls 10 at the front end of the head 1A are connected to the front face 12 of the shoulder by curved portions 13.

The walls 10 extend outwardly at their tops to provide respective clip-engaging surfaces 11 provided with a clip-engaging projection 110, which projects downwardly. The clip-engaging surfaces 11 are inclined downwardly from the rear of the shoulder 1 to the front of the shoulder 1, for deflecting the leg of a railway rail fastening clip. The front face 12 of the shoulder 1 is provided with projections 120 for engaging with the sleeper mould so as to set the shoulder at the correct height in the mould before the concrete is introduced. Alternatively, a single shelf could be provided instead of the two projections 120. The shoulder 1 has a rear face 15 opposite to the front face 12.

Referring once again to FIGS. 1A to 1N, the major face 20 of the plate 2 is formed with upstanding tabs 27 which are provided for cooperating with respective features 127 on the underside of the shoulder 1 to retain the plate 2 on the shoulder 1 (and vice versa) before the plate 2 and shoulder 1 have been set into the concrete of the sleeper. Apertures 26 are also provided in the major face of the plate 2 to allow formation of the underside of tabs 27 during manufacture of the sealing plate 2.

The shoulder 1 is held in place and positioned in the mould by means of a mechanism which pulls on the head 1A that protrudes through the bottom of the mould. The projections 120 on the shoulder 1 serve to reduce the amount of this pulling force which is applied to the sealing plate, which might otherwise distort.

The first major face 20 of the plate 2 is also formed with an elongate upstand 25 along part of the rear edge of the plate 2 which assists in retaining the component 7, the elongate member 74 of the component 7 being positioned between the upstand 25 and the tabs 27 when the component is in use.

The second major face 21 of the plate 2, which forms the underside of the plate, is formed with a plurality of intersecting ribs 28 which define numerous rebates 29. When the plate is set into the top surface of a concrete sleeper, these rebates 29 are filled with concrete, providing additional strength to the plate 2, and thereby reducing the amount of material, and hence cost, required to make the plate 2.

A railway rail fastening assembly employing the elements described above will now be described with reference to FIGS. 4A to 4C. The railway rail fastening assembly of FIGS. 4A to 4C, for fastening a railway rail 5, comprises a shoulder 1 as described with reference to FIG. 3, a rail fastening clip 3, a component 7 embodying the first aspect of the present invention as described with reference to FIG. 1A-1M, a sealing plate 2 embodying the second aspect of the present invention as described with reference to FIG. 2 and a rail pad 4. It will be appreciated that, although not shown in FIGS. 4A to 4C, when in use the stems 1B of the shoulder 1 are embedded in the concrete sleeper 6. The sealing plate 2 is also embedded in the concrete sleeper 6, such that the top face of sealing plate 2 is flush with the upper surface of the sleeper 6. The clip 3 may be driven into the shoulder 1 by introducing the chamfered free ends of clip legs 31, 37 into the gaps between the top surfaces 75*a* of the clip seat regions 75 on the component 7 and the clip-engaging surfaces 11 on the outer surface of the walls 10 of the shoulder 1, and inserting a toe portion of the clip 3, bearing a toe insulator 34*a*, into the space between the inner surfaces of the walls 10 of the shoulder 1, such that the toe of the clip 3, through the toe insulator 34*a*, bears on the ramp 140 of the shoulder 1. This position is known as the "pre-assembly" or "parked" position, in which the clip does not bear on the rail 5, but overlies shelf 77 of component 7. Interlocking features on the toe insulator 34*a* and ramp 140 prevent the clip 1 "backing off" out of the shoulder 1. Downwardly-facing parts of the legs 31, 37 rest on the top surfaces 75*a* of the clip seat regions 75.

The clip 3 can be driven from the pre-assembly position (first operative position) into a second operative position in which the toe portion of the clip 3 bears on the foot of the rail 5, the projections 110 on the walls 10 engage detents in the legs 31, 37 of the clip 3 and second and sixth portions 32, 36 (heel portions) of the clip 3 bear on the top surfaces 75*a* of the clip seat regions 75. The clip 3 overlies the shelf 77 of the side post insulator portion of the component 7. The clip can be withdrawn from this position back into the pre-assembly position, if required in order to remove or work on the rail.

As the clip 3 is installed, the toe of the clip 3 is driven upwards by the ramp 140 in the centre of the shoulder 1, and the legs 31, 37 are driven down, thereby spreading the clip apart. This makes it possible to make the assembly a little lower than would otherwise be possible.

The invention claimed is:

1. Apparatus for use in a railway rail fastening assembly, which apparatus comprises:

a railway rail clip anchoring device for retaining a railway rail fastening clip of a railway rail fastening assembly, the clip having a first part for bearing on a railway rail and a heel portion, the clip being separable from the anchoring device, the anchoring device having a head and a stem, the stem extending from the head for securing the anchoring device to a concrete sleeper, the head comprising a substantially upright front face configured for location adjacent to a foot of a railway rail, and two interconnected spaced-apart walls adapted to hold between them a portion of the clip to be retained, and clip-engaging means comprising a downwardly-projecting projection, provided by the walls, for engaging an upwardly-facing surface of a portion of the rail fastening clip to be retained, wherein the device does not have any feature or surface which engages a downwardly-facing surface of that clip portion; and a component comprising a first portion, a second portion and a connection portion interconnecting and spacing apart the first and second portions, the first portion being adapted for location between the front face of the rail clip anchoring device and a side of the foot of the railway rail and to receive a lateral load from the a railway rail, and the second portion being adapted for location on an opposite side of the anchoring device to its front face, and serving as a heel seat portion configured to receive the heel portion of the rail fastening clip.

2. Apparatus as in claim 1, wherein the said first portion of the component is adapted to transmit the lateral load received from the rail to the rail clip anchoring device.

3. Apparatus as in claim 1, herein the connection portion of the component comprises at least one elongate member extending between the first and second portions thereof.

4. Apparatus as in claim 3, wherein the or each elongate member is not adapted to receive lateral load from the rail.

5. Apparatus as claimed in claim 1, wherein the connection portion of the component joins the first and second portions of the component such that, when the first portion is located between the anchoring device and the rail foot, the connection portion extends outside the periphery of the anchoring device.

6. Apparatus as in claim 1, wherein the connection portion of the component comprises two elongate members, one elongate member extending between respective first points on the first and second portions and the other elongate member extending between respective second points on the first and second portions.

7. Apparatus as in claim 3, wherein a region bounded by the interconnected elongate members, first portion and second portion is shaped so as to accommodate the rail clip anchoring device.

8. Apparatus as in claim 7, wherein the component is shaped so as to fit closely around a base portion of the anchoring device.

9. Apparatus as in claim 1, wherein the component is integrally formed.

10. Apparatus as in claim 1, wherein at least the said first portion of the component is formed of electrically-insulating material.

11. Apparatus as in claim 1, wherein the component is formed of plastic material.

12. Apparatus as in claim 1, wherein the second portion of the component comprises at least one structure which extends upwardly, when the component is in use, to define a clip-receiving surface.

13. Apparatus as claimed in claim 12, wherein the second portion comprises two spaced-apart clip seat regions, each having a clip-receiving surface.

14. Apparatus as claimed in claim 13, wherein the said clip seat regions are formed by respective interconnected structures.

15. Apparatus as in claim 13, wherein the component is approximately rectangular in outline and the clip seat regions are located respectively at adjacent corners of the component.

16. Apparatus as in claim 13, wherein each clip seat region is substantially L-shaped in cross-section when viewed substantially perpendicularly to the clip receiving surfaces.

17. Apparatus as in claim 1, wherein the said first portion of the component has at least one part which overlies part of the anchoring device.

18. Apparatus as in claim 17, wherein the said at least one part is such that it is overlain by the said rail fastening clip when the clip is retained by the said anchoring device.

19. An apparatus as in claim 1, the clip-engaging means define contact regions at which the device engages the rail clip to be retained when the clip bears on a railway rail, the device not engaging the clip at any other region of the device when the clip is bearing on the rail in normal operation, wherein none of the said contact regions of the device can be seen when the anchoring device is viewed from above when in its operative orientation in which it will be used when adjacent to a railway rail and wherein all of the said contact regions of the device can be seen when the anchoring device is viewed from below when in the said operative orientation.

20. Apparatus as in claim 1, wherein the walls of the anchoring device are interconnected by an anchoring device connection portion which has a part which extends between the said walls from the one end thereof, which will be closest to the railway rail when the device is in use, towards the other end thereof and has a top surface which extends in a downwardly-inclined direction so as to form a ramp for deflecting a portion of the said railway rail fastening clip to be retained as it is driven into the anchoring device, and a tab on the an associated sealing plate is operable to engage with the said ramp of the anchoring device.

21. Apparatus as in claim 20, wherein the said connection portion of the anchoring device has a bearing face which extends between the said one end of the walls at a location below the said top surface.

22. Apparatus as claimed in claim 21, wherein a height of the said bearing face is less than that of the said walls.

23. Apparatus as claimed in claim 22, wherein a height of the said connection portion at the said one end of the walls is approximately half that of the said walls.

24. Apparatus as in claim 20, wherein that said part of the anchoring device connection portion forming a ramp is connected to the said walls along its side edges.

25. An apparatus as in claim 1, where a sealing plate is adapted for extending over an underside of the head when the stem of the device is being set in a concrete sleeper, thereby to prevent ingress of concrete into the head of the device, and for being retained on the surface of the sleeper thereafter.

* * * * *